US009752272B2

(12) United States Patent
Yeom et al.

(10) Patent No.: US 9,752,272 B2
(45) Date of Patent: Sep. 5, 2017

(54) REVERSIBLE DOOR

(71) Applicant: SAMSUNG ELECTRONICS CO., LTD., Suwon-si, Gyeonggi-do (KR)

(72) Inventors: Chang Bae Yeom, Yongin-si (KR); Ji Hoon Seong, Suwon-si (KR); Nu Ri Shin, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 66 days.

(21) Appl. No.: 14/840,684

(22) Filed: Aug. 31, 2015

(65) Prior Publication Data

US 2015/0368947 A1 Dec. 24, 2015

Related U.S. Application Data

(62) Division of application No. 13/626,171, filed on Sep. 25, 2012, now Pat. No. 9,145,636.

(30) Foreign Application Priority Data

Sep. 26, 2011 (KR) ..... 10-2011-0096768

(51) Int. Cl.

| | |
|---|---|
| ***D06F 39/14*** | (2006.01) |
| ***D06F 58/20*** | (2006.01) |
| ***E05D 7/02*** | (2006.01) |
| ***D06F 58/04*** | (2006.01) |
| ***E05D 15/50*** | (2006.01) |

(52) U.S. Cl.

CPC ..... *D06F 39/14* (2013.01); *D06F 58/04* (2013.01); *D06F 58/20* (2013.01); *E05D 7/02* (2013.01); *E05D 15/50* (2013.01); *E05Y 2900/312* (2013.01)

(58) Field of Classification Search

CPC ..... D06F 39/14; D06F 58/20
USPC ..... 68/196; 34/603
See application file for complete search history.

(56) References Cited

U.S. PATENT DOCUMENTS

| | | | |
|---|---|---|---|
| 5,113,562 | A | 5/1992 | Studt |
| 5,253,433 | A | 10/1993 | Frey |
| 7,363,781 | B2 | 4/2008 | Erickson |
| 7,559,156 | B2 | 7/2009 | Renzo |
| 7,614,162 | B2 | 11/2009 | Renzo |

(Continued)

FOREIGN PATENT DOCUMENTS

| | | | |
|---|---|---|---|
| EP | 2147996 | 1/2010 | |
| EP | 2402499 A1 * | 1/2012 | ..... D06F 39/14 |
| WO | WO 2009/083135 | 7/2009 | |

OTHER PUBLICATIONS

U.S. Office Action issued Mar. 23, 2015 in copending U.S. Appl. No. 13/626,171.

(Continued)

*Primary Examiner* — Joseph L Perrin
(74) *Attorney, Agent, or Firm* — Staas & Halsey LLP

(57) ABSTRACT

A laundry handling apparatus having a body provided with an inlet, a door to open/close the inlet, and a hinge assembly for the door to be rotatably installed to the body. The door is provided at both sides of a rear surface thereof with a hinge installation part at which the hinge assembly is installed, and the hinge assembly is installed at one of the two hinge installation parts, thereby enabling the change of an opening/closing direction of the door in a convenient manner.

4 Claims, 6 Drawing Sheets

(56) References Cited

U.S. PATENT DOCUMENTS

| | | | |
|---|---|---|---|
| 7,997,105 | B2 | 8/2011 | Hill et al. |
| 8,266,816 | B2 | 9/2012 | Lim |
| 8,382,216 | B2 | 2/2013 | Favaro et al. |
| 2009/0064534 | A1 | 3/2009 | LeClerc |
| 2009/0126417 | A1 | 5/2009 | Ripley et al. |
| 2010/0295428 | A1 | 11/2010 | Favaro et al. |

OTHER PUBLICATIONS

U.S. Notice of Allowance issued Jul. 1, 2015, 2015 in copending U.S. Appl. No. 13/626,171.
U.S. Appl. No. 13/626,171, filed Sep. 25, 2012, Chang Bae Yeom, Samsung Electronics Co., Ltd.
Korean Office Action dated Feb. 1, 2017 from Korean Patent Application No. 10-2011-0096768, 10 pages.
Korean Notice of Allowance dated Jun. 29, 2017 in related Korean Application 10-2011-0096768.

* cited by examiner

REVERSIBLE DOOR

CROSS-REFERENCE TO RELATED APPLICATIONS

This application is a divisional of U.S. application Ser. No. 13/626,171 filed on Sep. 25, 2012, which claims the benefit of Korean Patent Application No. 10-2011-0096768, filed on Sep. 26, 2011 in the Korean Intellectual Property Office, the disclosures of which are incorporated herein by reference.

BACKGROUND

1. Field

Embodiments of the present disclosure relate to a laundry handling apparatus having a door configured to open/close an inlet provided at a front surface of a body thereof.

2. Description of the Related Art

In general, a laundry handling apparatus includes a washing machine configured to wash a laundry and a drying apparatus configured to dry a laundry that is washed.

A laundry handling apparatus includes a body provided with an inlet at a front surface thereof to input a laundry into the inside thereof and a door rotatably installed at one side of a front surface of the body to open/close the inlet.

In general, a door having a circular shape applied to the laundry handling apparatus is widely used. Recently, a laundry handling apparatus that is provided with a rectangular shaped inlet at a body thereof and including a rectangular shape door to open/close the rectangular shape inlet, so that a laundry at an inside thereof may be easily taken out, has also been developed.

A rectangular shaped door may be provided with an upper portion and a lower portion in an asymmetrical manner according to a design thereof, and the rectangular shaped door as such may not be installed at a body in a state where the opening/close direction can be changed, and thus a rectangular door needs to be manufactured according to an opening/closing direction.

SUMMARY

Therefore, it is an aspect of the present disclosure to provide a laundry handling apparatus having an opening/closing direction of a door changeable.

It is another aspect of the present disclosure to provide a laundry handling apparatus having a door easily installed thereto.

Additional aspects of the disclosure will be set forth in part in the description which follows and, in part, will be apparent from the description, or may be learned by practice of the disclosure.

In accordance with one aspect of the present disclosure, a laundry handling apparatus includes a body, a door and a hinge assembly. The body may be provided with an inlet thereto to input a laundry. The door may have one end thereof hinged to the body to open/close the inlet and having two hinge installation parts each provided at both sides of a rear surface thereof in a concave manner. The hinge assembly may be installed at one of the two hinge installation parts so that the door is rotatably installed to the body.

The hinge assembly may include a hinge member installed at the body, and a hinge bracket installed at one of the two hinge installation parts and provided with the hinge member rotatably coupled thereto.

The hinge member may include a fixation part fixed to the body, a hinge part having a circular cross section and rotatably installed at the hinge bracket, and a connecting part configured to connect the fixation part to the hinge part. The hinge bracket may include a first hinge bracket and a second hinge bracket that have the hinge part rotatably installed thereinbetween.

The second hinge bracket may include a hinge groove at which the hinge part is rotatably installed, and the second hinge bracket may include a hinge supporting part for the hinge part to maintain a state of being installed at an inside the hinge groove.

The laundry handling apparatus may further include an installation part cover to cover the other one of the two hinge installation parts.

The installation part cover may include a latch for an inlet to maintain a closed state by a door.

The door may have an upper portion and a lower portion that are asymmetrical to each other.

The door may be formed in a rectangular shape.

The laundry handling apparatus may further include a fixation bracket disposed at a rear surface of a front panel forming a front surface of the body for an installation of the hinge member. The hinge member may include a supporting part protruding from a rear surface of the fixation part and penetrating the front panel so as to be supported by the fixation bracket, and at least one first fastening hole to fix the hinge member to the front surface of the body. The fixation bracket may include a second fastening hole provided at a position corresponding to the first fastening hole and a supporting hole into which the supporting part is inserted and supported thereto.

The supporting part may be provided with both side surfaces formed in parallel to each other in a shape of flat plane, and the supporting hole may be provided with both side ends formed in parallel to each other in a linear shape to correspond to the supporting part.

The fastening hole may be formed at least one of an upper side and a lower side of the supporting part.

In accordance with another aspect of the present disclosure, a laundry handling apparatus includes a body, a door, a hinge member and a fixation bracket. The body may be provided with an inlet to input a laundry thereto. The door may have one end thereof hinged to the body to open/close the inlet. The hinge member may be configured to enable the door to be rotatably installed at the body. The fixation bracket may be disposed at a rear surface of a front surface panel forming a front surface of the body for an installation of a hinge assembly. The hinge member may include a supporting part protruding from a rear surface of a fixation part, which is fixed to the body, and penetrating the front panel so as to be supported by the fixation bracket, and at least one first fastening hole to fix the hinge member to the front surface of the body. The fixation bracket may include a second fastening hole provided at a position corresponding to the first fastening hole, and a supporting hole into which the supporting part is inserted and supported thereto.

As described above, by reversing the installation positions of the hinge assembly and the installation part cover installed at the door, the opening/closing direction of the door may be simply changed.

In addition, as described above, since the hinge member is supported at the supporting hole of the fixing bracket through the supporting part, if a screw is fastened to one of the first fastening holes and one of the second fastening holes both of which correspond to each other, the remaining one of the first fastening holes and the remaining one of the second fastening holes are positioned to correspond to each other, so that the screw may be easily fastened to the remaining one of the first fastening holes and the remaining one of the second fastening holes.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
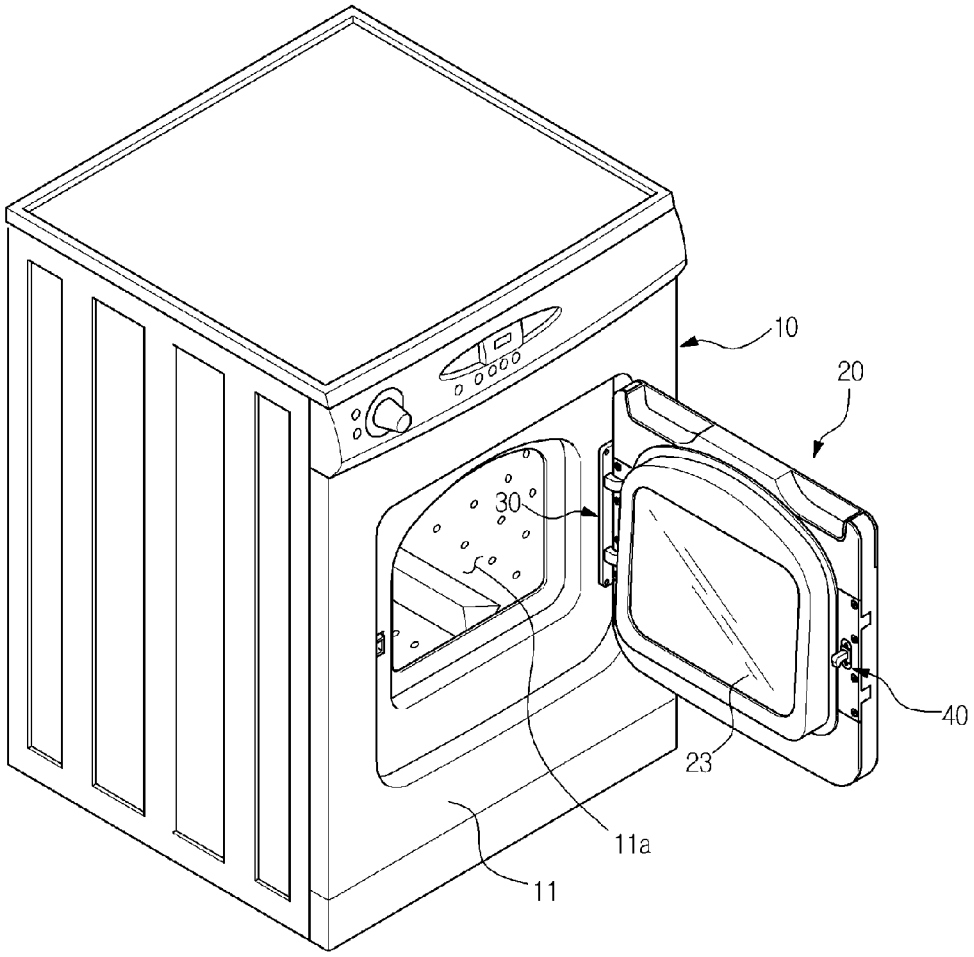
FIG. 1 is a perspective view illustrating a laundry handling apparatus according to an embodiment of the present disclosure.

Reference will now be made in detail to the embodiments of the present disclosure, examples of which are illustrated in the accompanying drawings, wherein like reference numerals refer to like elements throughout.

Referring to FIG. 1, a laundry handling apparatus according to an embodiment of the present disclosure includes a body 10 forming an exterior and provided with an inlet 11*a* at a front surface thereof to input a laundry, a door 20 having one end thereof rotatably installed at the body 10 while rotating in left and right directions to open/close the inlet 11*a*, and a hinge assembly 30 for the door 20 to be rotatably installed at the body 10.

The door 20 according to the embodiment of the present disclosure is formed in a rectangular shape having an upper portion and a lower portion thereof to be asymmetric to each other, and is provided with a transparent window 23 at a center thereof to check a laundry at an inside the door 20. In addition, the door 20, as illustrated on FIG. 2, includes a door front surface frame 21 forming a front surface of the door 20 and a door rear surface frame 22 forming a rear surface of the door 20. The door front surface frame 21 is provided with a hole having a shape corresponding to a hole of the door rear surface frame 22 and the door front surface frame 21 and the door rear surface frame 22 are provided with a transparent member such as a tempered glass fixed therebetween, thereby forming the transparent window 23 which has been described above.

Figure 3:
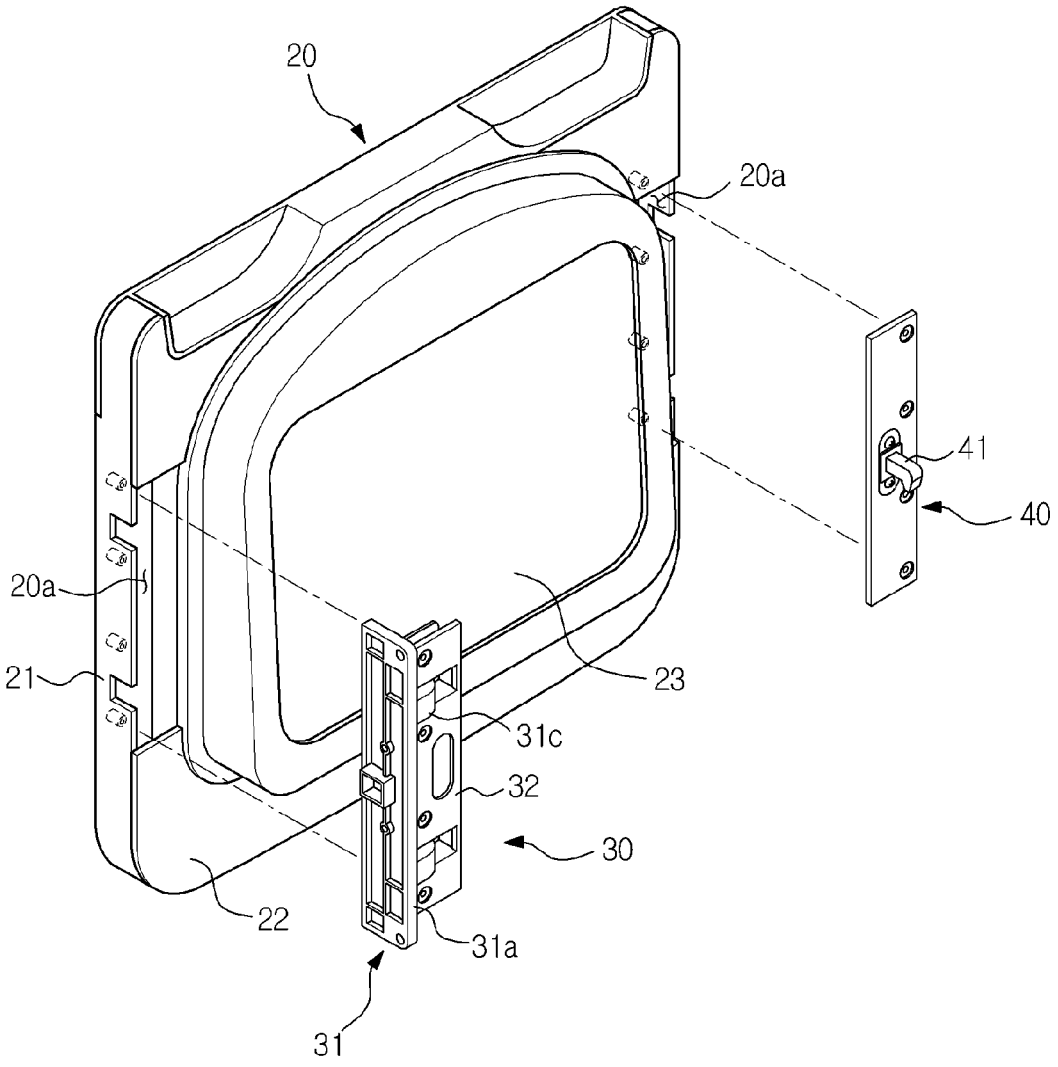
FIGS. 3 to 4 are perspective views illustrating a hinge assembly and an installation cover part installed at the door applied to the laundry handling apparatus according to the embodiment of the present disclosure.
Figure 4:
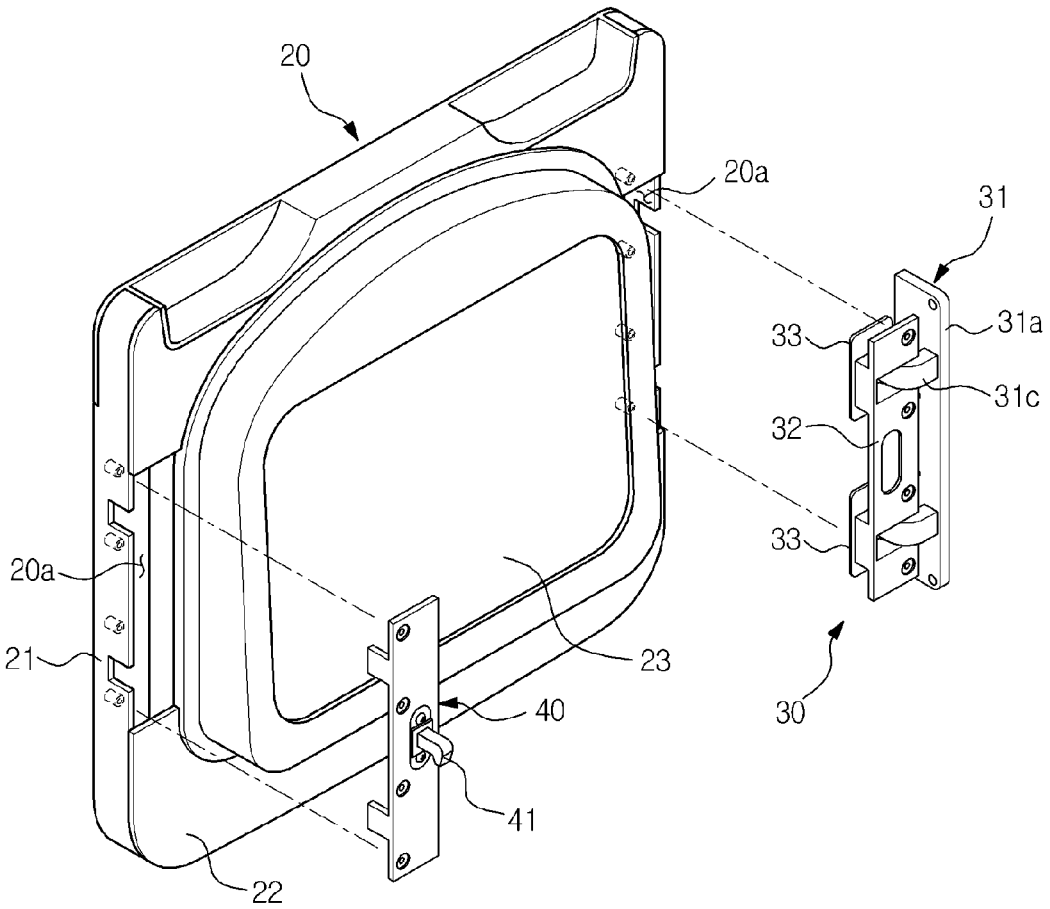

Referring to FIGS. 3 and 4, the door 20 is provided with two hinge installation parts 20*a* at both sides of a rear surface thereof, respectively, for installation of the hinge assembly 30. The hinge assembly 30 is installed at one of the two hinge installation parts 20*a* while an installation cover part 40 configured to cover the hinge installation part 20*a* is installed at the remaining one of the two hinge installation parts 20*a*. The hinge installation part 20*a* according to the embodiment of the present disclosure is formed in a shape of a groove by cutting a portion of both sides of the door rear surface frame 22.

Thus, by reversing the hinge installation part 20*a*, at which the hinge assembly 30 may be installed, and the hinge installation part 20*a*, at which the installation part cover 40 may be installed, the opening/closing direction of the door 20 may be reversely changed. That is, when viewed from a front side of the body 10, the hinge assembly 30 is installed at the hinge installation part 20*a* positioned to the right of the laundry handling apparatus and the installation cover 40 is installed at the hinge installation part 20*a* positioned to the left of the laundry handling apparatus, so that the inlet 11*a* is open as the door 20 rotates from a left side to a right side thereof. When viewed from a front side of the body 20, the hinge assembly 30 is installed at the hinge installation part 20*a* positioned to the left of the laundry handling apparatus and the installation cover 40 is installed at the hinge installation part 20*a* positioned to the right of the laundry handling apparatus, so that the inlet 11*a* is open as the door 20 rotates from a right side to a left side thereof.

Figure 2:
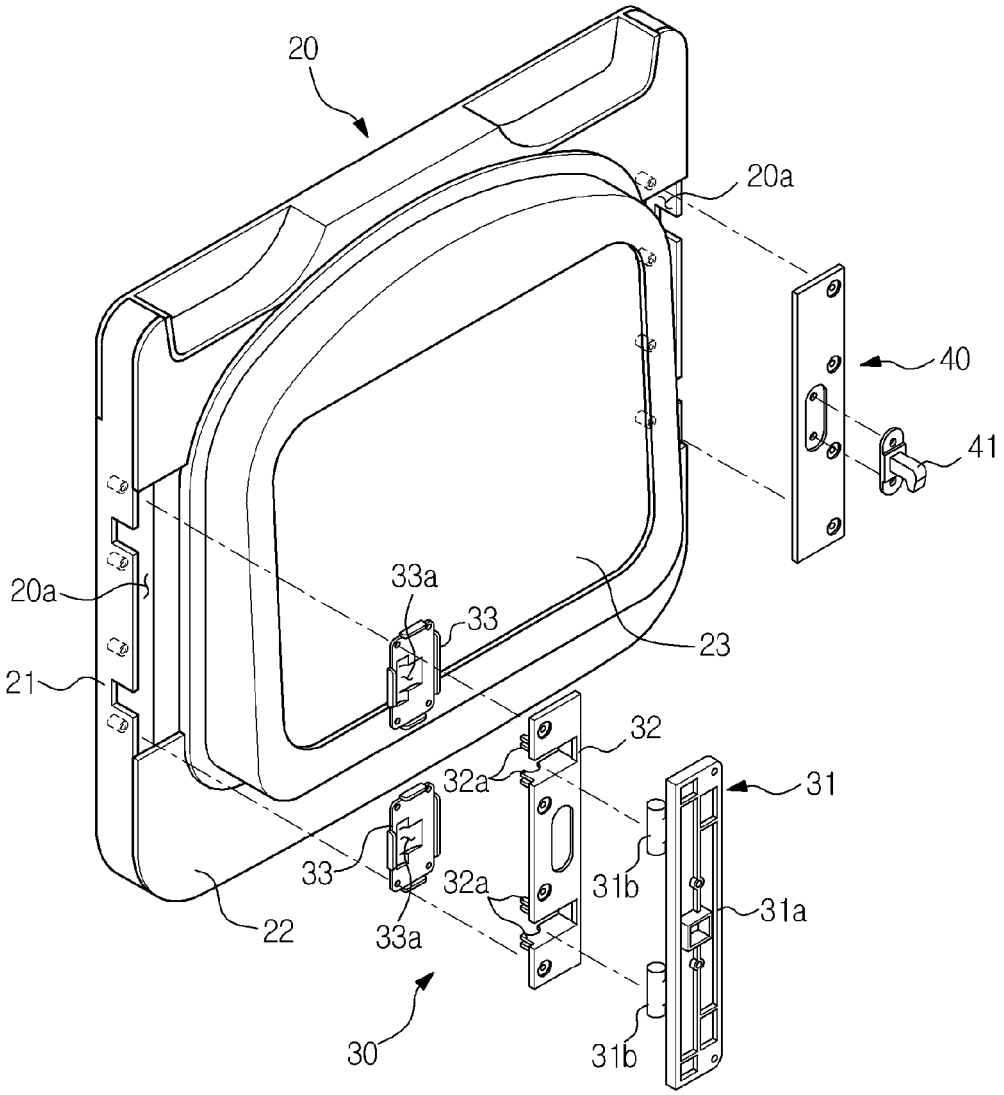
FIG. 2 is an exploded perspective view illustrating a door and a hinge assembly applied to the laundry handling apparatus according to the embodiment of the present disclosure.

The hinge assembly 30, as illustrated on FIG. 2, includes a hinge member 31 installed at a front surface of the body 10, and hinge brackets 32 and 33 that installed to the door 20 to have the hinge member 31 rotatably coupled thereto so that the door 20 may be rotatably installed at the body 10.

The hinge member 31 includes a fixation part 31*a* formed in a shape of a panel and fixedly installed to the body 10 through a screw S, a hinge shaft 31*b* having a circular cross section and rotatably installed at the hinge brackets 32 and 33, and a connecting part 31*c* connecting the fixation part 31*a* to the hinge shaft 31*b*. The hinge shaft 31*b* according to the embodiment of the present disclosure is provided with two units thereof at an upper portion and a lower portion of the door 20, respectively, to reduce the door 20 being deflected.

The hinge brackets 32 and 33 include a first hinge bracket 32 and a second hinge bracket 33 coupled to each other so that the hinge shaft 31*b* may be rotatably installed between the first hinge bracket 32 and the second hinge bracket 33. The second hinge bracket 33 according to the embodiment of the present disclosure includes a hinge groove 33*a* at which the hinge shaft 31*b* is rotatably accommodated. The first hinge bracket 32 is installed to cover the hinge installation part 20*a*, and includes a hinge supporting part 32*a* for the hinge shaft 31*b* to maintain a state of an installation at the hinge groove 33*a*. Since two units of hinge shafts 31*b* are provided at the hinge member 31 according to the embodiment of the present disclosure, the second hinge bracket 33 is provided with two units thereof and the two hinge brackets 33 are coupled to an upper portion and a lower portion of the first hinge bracket 32, respectively.

The installation cover 40 includes a latch 41 allowing the door 20 to maintain a closed state of the inlet 11*a* while interacting with a locking apparatus (not shown) installed at the body 10.

Figure 5:
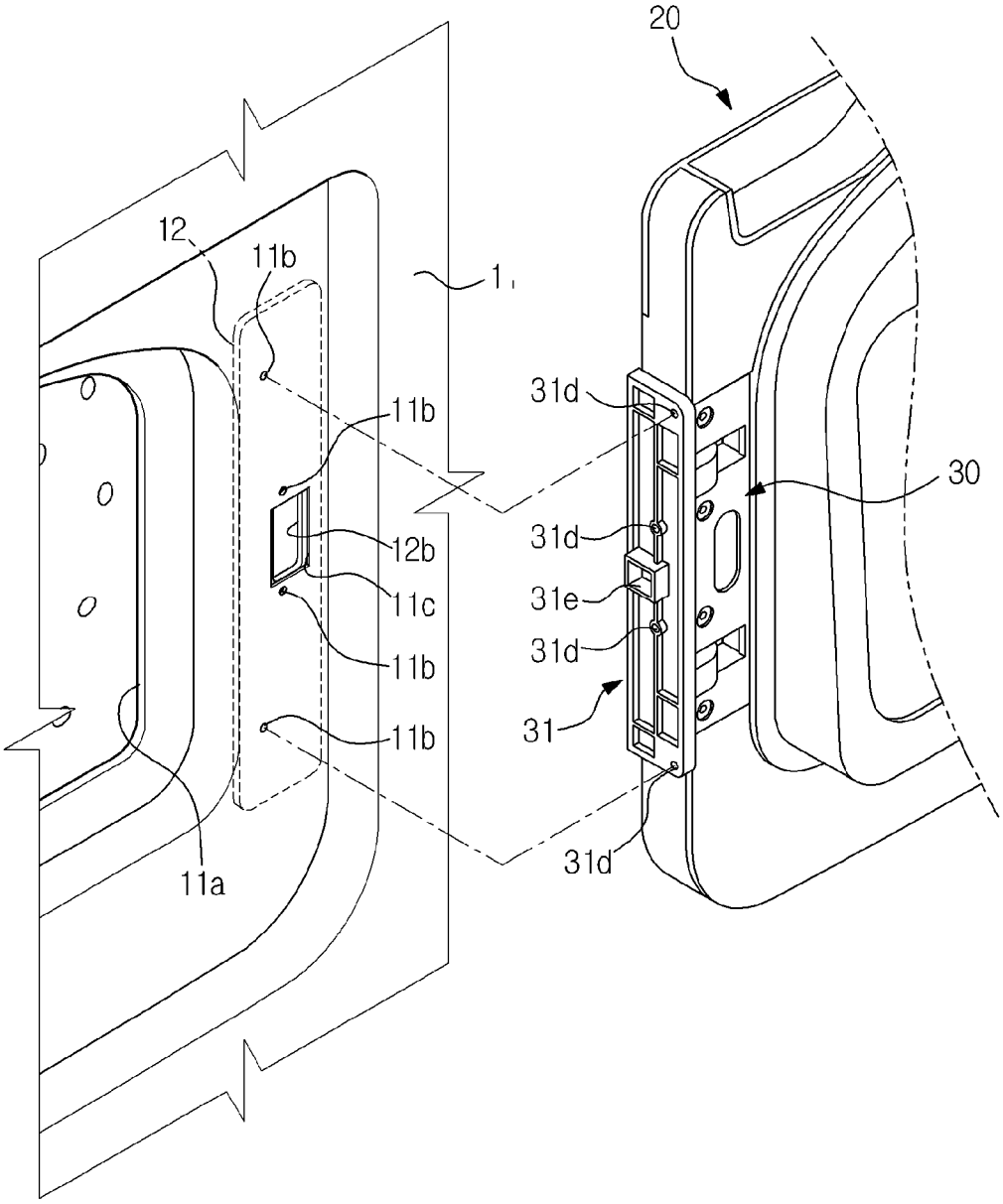
FIGS. 5 to 6 are exploded perspective views illustrating a hinge member being installed at a front surface panel of a body of the laundry handling apparatus according to the embodiment of the present disclosure.
Figure 6:
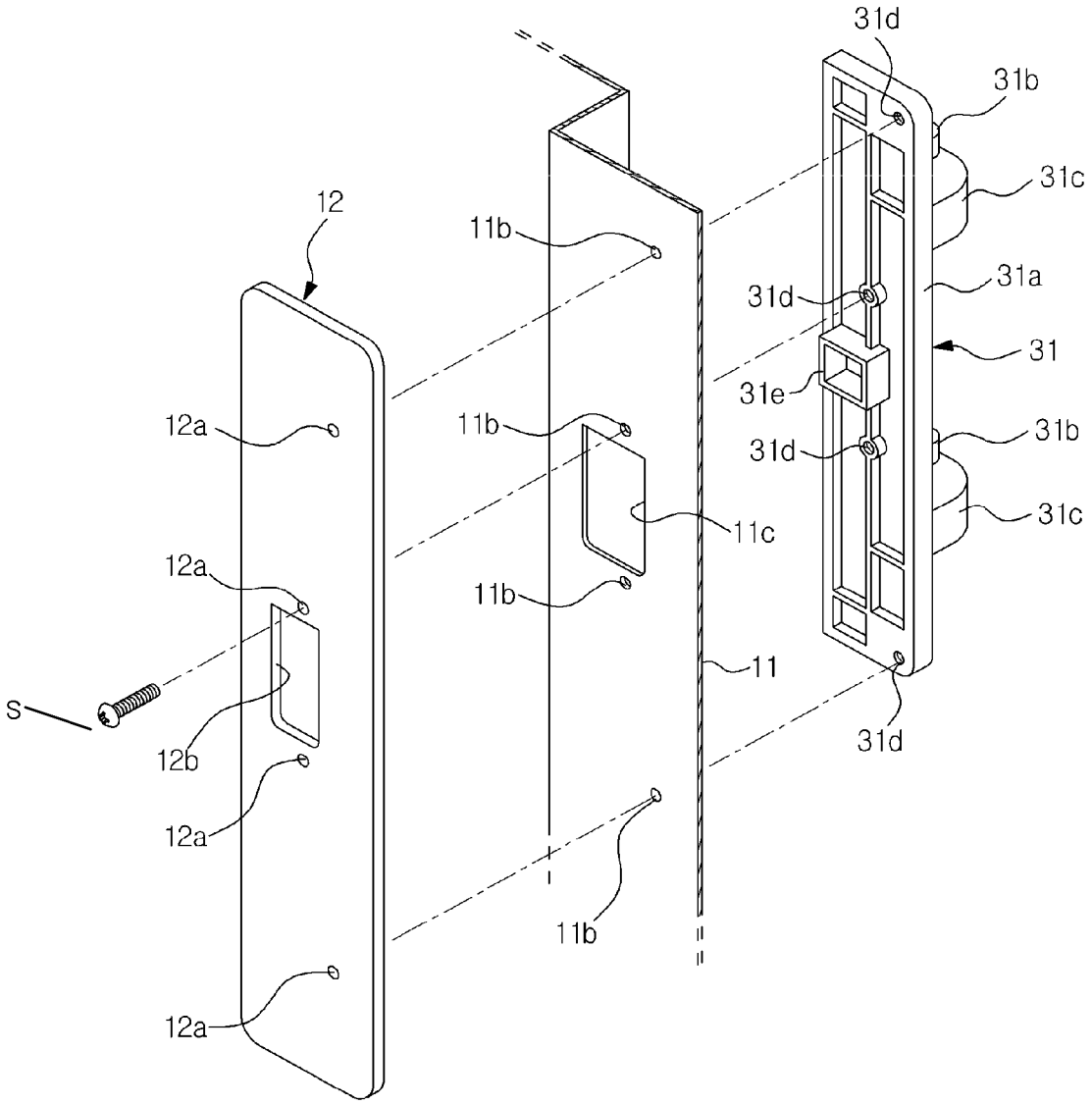

In addition, as illustrated on FIGS. 5 to 6, in order to install the hinge brackets 32 and 33 to the body 10, a fixation bracket 12 is disposed to a rear surface of a front panel 11, which forms a front surface of the body 10, for the hinge member 31 to be fixedly installed at the front surface of the body 10.

The fixation part 31*a* of the hinge member 31 is provided with a first fastening hole 31*d* for the hinge member 31 to be fixedly coupled to the fixation bracket 12 through the screw S, and the fixation bracket 12 is provided with a second fastening hole 12*a* at a position corresponding to the first fastening hole 31*d*. Accordingly the hinge member 31 may be fixedly installed at the fixation bracket 12 by fastening the screw S at the first fastening hole 31*d* and the second fastening hole 12*a*. Each of the first fastening hole 31*d* and the second fastening hole 12*a* of the embodiment of the present disclosure is provided in plurality at an upper portion and a lower portion at positions, each first fastening hole 31*d* corresponding to each second fastening hole 12*a* so that the hinge member 31 may be prevented from being rotated by the gravity of the door 20. In addition, the front surface panel 11 is provided with a third fastening hole 11*b* at a position corresponding to the first fastening hole 31*d* and the second fastening hole 12*a* so that the screw S may be penetrated and installed to the first fastening hole 31*d* and the second fastening hole 12*a*.

When installing the hinge assembly 30 or the hinge member 31 being coupled to the door 20, the hinge member 31 may be rotated by the gravity of the door 20 in a state that the screw S is coupled to one of the first fastening hole 31*d* and one of the second fastening hole 12*a*. In this case, in order to fasten the screw S to the remaining one of first fastening holes 31*d* and the remaining one of the second fastening holes 12*a*, the door 20 needs to be held in a way to prevent the hinge member 31 from being rotated when the screw S is needed to be fastened to the remaining one of first fastening holes 31*d* and the remaining one of the second fastening holes 12*a*.

Thus, the fixation part 31*a* of the hinge member 31 is provided with a supporting part 31*e* protruded from a rear surface thereof and supported by the fixation bracket 12, and the fixation bracket 12 is provided with a supporting hole 12*b* into which the supporting part 31*e* is inserted and supported. The front surface panel 11 is provided with a penetrating hole 11*c* thereto so that the supporting part 31*e* may penetrate through the penetrating hole 11*c* and be inserted into the supporting hole 12*b*. The supporting part 31*e* according to the embodiment of the present disclosure is provided in between the two units of the first fastening holes 31*d* that are vertically disposed. That is, the first fastening hole 31*d* is provided each at an upper side and a lower side of the supporting part 31*e*.

In addition, the supporting part 31*e* is provided with both side surfaces thereof each formed in a shape of a plane surface that is parallel to each other, and the supporting groove 12*b* is provided with both side ends thereof each formed in a linear shape that is parallel to each other so that the both side ends may correspond to the supporting part 31*e*. Thus, as the both side surfaces of the supporting part 31*e* are either line-contacted or surface-contacted with the both side ends of the supporting hole 12*b*, the supporting part 31*e* is supported by the both side ends of the supporting hole 12*b* in a further stable manner, and thus the rotation of the hinge member 31 is prevented.

With respect to the laundry handling apparatus structured as such, the following is a description of an installation process of a door in a state of an opening/closing direction thereof changed.

First, as illustrated on FIG. 1, in a state when a right end side of the door 20 is installed on a right side of the body through the hinge assembly 30, the hinge assembly 30, that is, the hinge member 31, is separated from the front surface panel 11 of the body 10, so that the door 20 is separated along with the hinge assembly 30. Then, the hinge assembly 30 and the installation part cover 40 are separated from the two units of the hinge installation part 20*a* provided at the rear surface of the door 20. Sequentially, each of the hinge assembly 30 and the installation part cover 40 is installed at the hinge installation part 20*a* that is positioned at an opposite side of the position at which the hinge assembly 30 and the installation part cover 40 are originally installed. That is, while having the drawing of FIG. 3 as a reference, the hinge assembly 30 installed at a left side of the rear surface of the door 20 and the installation part cover 40 installed at a right side of the rear surface of the door 20 are installed at opposite positions, as illustrated on FIG. 4.

As described above, in a state of the hinge assembly 30 installed to the door 20 while having the hinge assembly 30 and the installation part cover 40 reversely changed in the position the hinge assembly 30 is fixed again to the front surface panel 11 of the body 10. The fixation of the hinge assembly 30 is taken place by fastening the hinge member 31 to the fixation bracket 12 that is disposed at a rear surface of the front surface panel 11 of the body 10 by use of the screw S.

First, the hinge member 31 is disposed such that the supporting part 31*e* of the hinge member 31 is installed by passing through the supporting groove 12*b*, one among the plurality of the first fastening holes 31*d* and one among the plurality of the second fastening holes 12*a* both of which correspond to each other are fastened with the screw S. At this time, even in a case when only one screw S is fastened at the first fastening hole 31*d* and the second fastening hole 12*a*, the hinge member 31 is in a state of being supported by the both side ends of the supporting hole 12*b* of the fixation bracket 12 through the both side surfaces of the supporting part 31*e*, and thus the hinge member 31 maintains a constant position without being rotated. Thus, the remaining one of the first fastening holes 31*d* and the remaining one of the second fastening holes 12*a* may maintain a corresponding position to each other, thereby enabling an operator to easily fasten a screw.

The door 20 according to the embodiment of the present disclosure is formed in a rectangular shape while being provided with an upper portion thereof and a lower portion thereof in an asymmetrical manner, but the present disclosure is not limited hereto, and the present disclosure may be applied to various shapes of doors each provided with an upper portion thereof and a lower portion thereof in an asymmetrical manner.

The first fastening hole according to the embodiment of the present disclosure is provided at both an upper side and a lower side of the supporting part, but is not limited thereto, and the first fastening hole may be formed at one side thereof.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A door for a laundry appliance, comprising:

a front frame;

a rear frame coupled to the front frame;

a transparent window configured to provide visual access to an inside of the laundry appliance through the transparent window;

a pair of hinge installation parts provided at opposing sides of the rear frame, respectively, each of the hinge installation parts comprising a cut-out portion of the rear frame; and a hinge assembly configured to be installed at either of the pair of hinge installation parts, wherein the hinge assembly comprises a first hinge bracket having a hinge supporting part, at least a portion of the first hinge bracket being exposed through the cut-out portion of the rear frame;

a second hinge bracket coupled to the front frame and having a hinge groove; and a hinge member having a hinge shaft disposed between the hinge supporting part and the hinge groove such that the hinge member is rotatably coupled to the door.

2. The door of claim 1, wherein the hinge member further comprises:

a fixation part configured to be coupled to the laundry appliance; and a connecting part configured to connect the hinge shaft to the fixation part such that the hinge shaft protrudes from both sides of the connecting part.

3. A laundry appliance, comprising:

a main body provided with an opening to load a laundry into the main body;

a reversible door coupled to either side of the opening;

a pair of hinge installation parts provided at opposing sides of the reversible door, each of the hinge installation parts comprising a recessed portion recessed from a rear surface of the reversible door; and a hinge assembly configured to be coupled to either of the pair of hinge installation parts, wherein the hinge assembly comprises a first hinge bracket having a hinge supporting part, at least a portion of the first hinge bracket being exposed through the recessed portion of the rear surface;

a second hinge bracket having a hinge groove; and a hinge member having a hinge shaft disposed between the hinge supporting part and the hinge groove such that the hinge member is rotatably coupled to the door.

4. The door of claim 3, wherein the hinge member further comprises:

a fixation part configured to be coupled to the main body; and a connecting part configured to connect the hinge shaft to the fixation part such that the hinge shaft protrudes from both sides of the connecting part.

* * * * *